United States Patent [19]

Moen et al.

[11] 4,128,132

[45] Dec. 5, 1978

[54] GROUND-ENGAGING TOOL INSERTS WITH ANGLED EDGES

[75] Inventors: Lowell J. Moen, Peoria; Harris S. Olson, Morton, both of Ill.

[73] Assignee: Caterpillar Tractor Co., Peoria, Ill.

[21] Appl. No.: 829,684

[22] Filed: Sep. 1, 1977

[51] Int. Cl.[2] ..... E02F 3/80

[52] U.S. Cl. ..... 172/747; 37/141 R; 75/126 P; 75/244

[58] Field of Search ..... 172/747, 719, 753, 765, 172/766; 37/141 R; 75/126 P, 244

[56] References Cited

U.S. PATENT DOCUMENTS

| | | | |
|---|---|---|---|
| 3,190,018 | 6/1965 | Nelson et al. | 172/719 X |
| 3,529,677 | 9/1970 | Stephenson | 172/747 X |
| 3,888,027 | 6/1975 | Toews | 172/719 X |
| 3,934,654 | 1/1976 | Stephenson et al. | 172/719 |
| 3,961,788 | 6/1976 | Helton et al. | 37/141 R |
| 3,970,445 | 7/1976 | Gale et al. | 75/0.5 B |
| 4,011,051 | 3/1977 | Helton et al. | 29/182 |
| 4,058,173 | 11/1977 | Carson | 172/719 |

FOREIGN PATENT DOCUMENTS

| | | | |
|---|---|---|---|
| 2423963 | 12/1974 | Fed. Rep. of Germany | 172/747 |

*Primary Examiner*—Paul E. Shapiro

*Attorney, Agent, or Firm*—Wegner, Stellman, McCord, Wiles & Wood

[57] ABSTRACT

A wear-resistant alloy is inlaid in a channel along the undersurface of a cutting edge of a ground-engaging implement. The wear-resistant alloy is in the form of individual blocks which are brazed within the channel. The joints between contiguous blocks are non-parallel to the general direction of travel of the ground-engaging implement for improved tool wear.

10 Claims, 5 Drawing Figures

GROUND-ENGAGING TOOL INSERTS WITH ANGLED EDGES

BACKGROUND OF THE INVENTION

This invention relates to an improved cutting edge for ground-engaging implements and, more particularly, to a bolt-on cutting edge assembly with an inlaid wear-resistant alloy.

Ground-engaging implements of earth-working machines are subject to severe wear as a result of heavy abrasion from the direct engagement of the cutting edge with clay, igneous and sedimentary rock, sand, ores and the like. Cutting edges of high carbon steel wear rapidly if in constant contact with the ground. To minimize maintenance and wear and tear on the parts, sectional and replaceable cutting edge assemblies have been developed facilitating an interchange of the expired blade at the job site. Also, wear-resistant alloys made especially for ground-engaging implements have been developed. These alloys are of boron, chromium and iron, and have a maximum hardness of a given composition. The alloys are of solid spheroidal particles held together in a matrix of a material different from the alloy. Such an alloy is described in U.S. Pat. No. 3,970,445 to Gale et al. and in U.S. Pat. No. 4,011,051 to Helton et al., both assigned to Caterpillar Tractor Co., Peoria, Ill.

These alloys are relatively expensive and are cast in the shape of small blocks or ingots and, as shown in FIG. 3 of U.S. Pat. No. 4,011,051, can be brazed along the distal portion of a motor grader edge. The single strip of blocks inlaid end to end, as shown in FIG. 3 of U.S. Pat. No. 4,011,051, is unacceptable for many applications since accelerated wear of the blocks occurs at their contiguous ends and objectionable grooving is experienced in the softer cutting edge material beneath the joints between contiguous blocks.

Considering the expense of the alloy described in the above patents and the desirability of providing the ground-engaging implement with it, I have developed an effective, yet economical and practical way of combining the alloy with the implement for a more effective tool having a longer life.

SUMMARY OF THE INVENTION

The present invention is directed to overcoming one or more of the problems as set forth above.

According to the present invention, a downwardly opening channel is provided along the lower surface of a cutting edge assembly for a ground-engaging implement. The channel is generally parallel to the cutting edge and extends in front of the forward edge of the implement. Blocks or ingots of a wear-resistant alloy described in the above-mentioned patents are cast in a nonorthogonal shape and are brazed within the channel for added wear of the assembly along the ground-engaging forward edge. The joints between contiguous blocks or ingots are nonparallel to the general direction of travel of the ground-enegaging implement. The assembly may be constructed in sections and may be secured to the implement by bolts.

BRIEF DESCRIPTION OF THE DRAWINGS

FIG. 1 is a perspective view of the wear-resistant cutting edge assembly coupled to an earth-working implement, such as a loader bucket or the like;

DESCRIPTION OF THE PREFERRED EMBODIMENT

Figure 1:
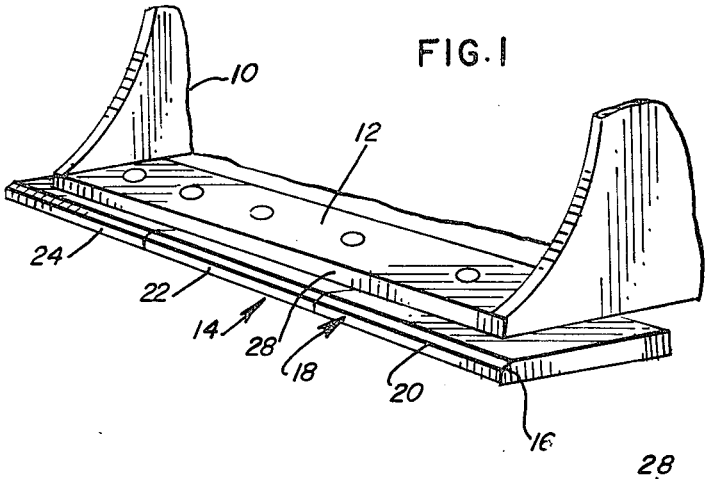

Referring to FIG. 1, a ground-engaging, earth-working implement 10 has a base 12 on which is bolted cutting edge assembly 14. The assembly may have a bevel 16 extending across the forward edge 18 to enhance penetration of the implement. The cutting edge assembly 14 may be of a single unit or may be constructed of a left section 20 (with respect to the operator, not shown), middle section 22 and right section 24, each section being similar to the other two. Sectional construction of the assembly is preferred since selective replacement of any one of the three sections is easily effected. Also, since the individual sections are heavy and more easily manipulated, sectional construction facilitates on-the-jobsite replacement. The assembly is attached to base 12 by bolts.

Figure 2:
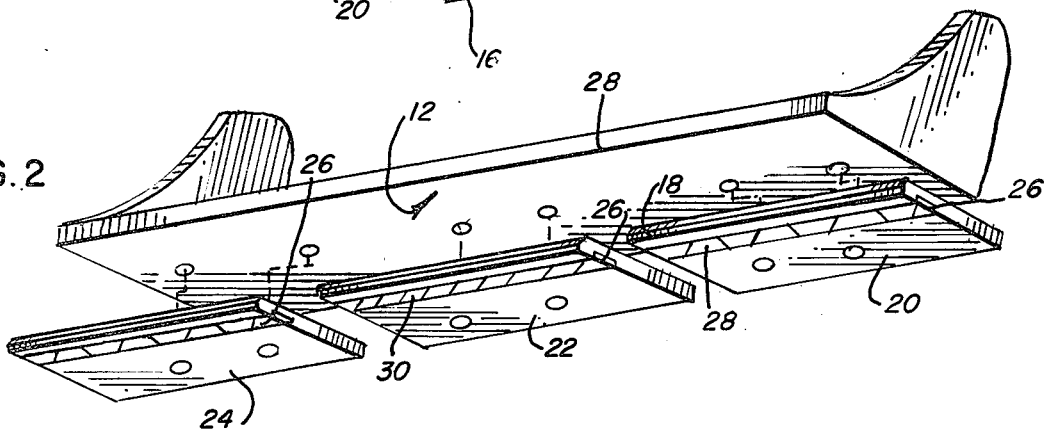
FIG. 2 is a perspective view depicting the underside of the cutting edge assembly shown in FIG. 1.
Figure 3:
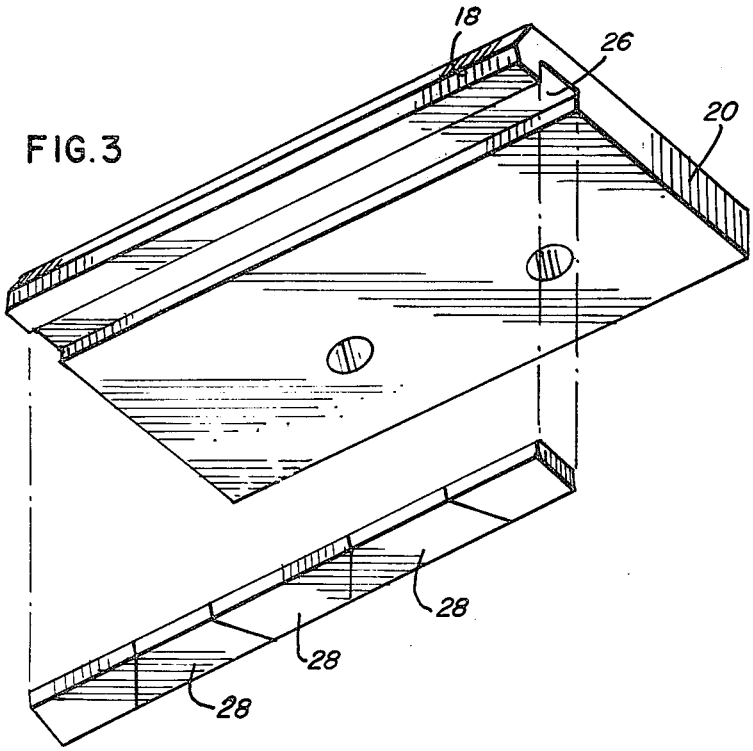
FIG. 3 is a detailed perspective exploded view of the wear-resistant material ready to be inlaid in a channel of one section of the wear-resistant cutting edge of FIG. 2.

Referring to FIG. 2, the lower surfaces of left section 20, middle section 22 and right section 24 are shown. Along forward cutting edge 18 there extends a channel 26 in each of the three sections inlaid with wear-resistant blocks or ingots, as block 28 of trapezoidal configuration or block 30 of a configuration of a parallelogram. Channel 26 extends forwardly of edge 28 of base 12 and its axis is usually perpendicular to the motion of the earth-working implement 10. Referring to FIG. 3, an explanation of the construction of the left section or assembly 20 will be provided, it being understood that middle section 22 and right section 24 are similarly constructed. Assembly 20 is of carbon steel approximately 1⅛ inches thick. The width of the assembly is approximately 13 inches and the length is approximately 27½ inches, although it should be understood that the depth, the width and the length substantially depend upon the size of the earth-working equipment on which the assembly is to be mounted. Channel 26 extends along forward edge 18 with approximately 1 inch between the channel 26 and the forward edge. Channel 26, in which it is anticipated that blocks, as blocks 28, are to be inlaid, is approximately 1½ inches wide and ¾ inches deep.

Although the wear-resistant alloy contemplated by the present invention is described in U.S. Pat. No. 3,970,445, U.S. Pat. No. 4,011,051 and U.S. Pat. No. 4,058,173, a brief description will be provided here for convenience. The alloy consists of spheroidal particles that have a composition of about 58% chromium, 9% boron, with the remainder iron, surrounded by a matrix alloy of iron and boron, in the amounts of about 3.8% boron and the remainder iron. The spheroidal particles are maintained in the matrix and are sufficiently closely spaced to block wear paths when abrasive wear occurs in the composite alloy material.

Figure 4:
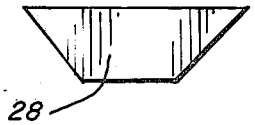
FIG. 4 shows an individual block the shape of which is conducive to improved joint wear; and, FIG. 5 shows another individual block configuration conducive to improved joint wear.
Figure 5:
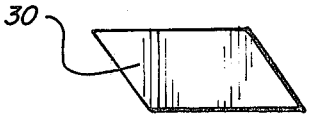

The composite alloy may be formed by casting the matrix alloy about the hard spheroids in a ceramic or graphite mold of a desired shape as that shown in FIGS. 4, a trapezoid, or 5, a parallelogram. The blocks or ingots, as blocks 28 and 30, are then inlaid within channel 26 of each of the three sections. Since the blocks have a nonorthogonal shape, the joints between contiguous blocks are nonparallel to the direction of movement of the ground-working equipment 10 when inlaid in channel 26. The blocks are secured to the assemblies and to each other by brazing or any other appropriate method. If brazing tends to weaken the steel of the assembly, it can be subjected to conventional heat treatment for hardening without adversely affecting the composite alloy material.

Although blocks in the shape of a trapezoid and a parallelogram have been shown and described, it is apparent that other block shapes are equally suitable so long as the joints between contiguous blocks are nonparallel to the direction of motion of earth-working implement 10. The sizes and shapes of the blocks 28 and 30 are uniform side-to-side so that several blocks of one shape, i.e. parallelogram 30, can be adapted to form a basis for the whole inlay. That is, a plurality of blocks 30, all of the same size and shape, can be utilized to lay up the whole inlay by matching and abutting the respective angled sides together. Every other block is inverted and nested against the previous block to build the inlay.

THE EMBODIMENT OF THE INVENTION IN WHICH AN EXCLUSIVE PROPERTY OR PRIVILEGE IS CLAIMED ARE DEFINED AS FOLLOWS:

1. In a cutting edge assembly for an earth-working machine having a forward cutting edge, the improvement comprising:

a channel extending generally parallel to the front cutting edge; and blocks of wear-resistant material inlaid within the front channel, the joints between contiguous blocks being nonparallel to the general direction of movement of the earth-working machine.

2. The cutting edge assembly of claim 1 wherein the joints are nonparallel to the front cutting edge.

3. The cutting edge assembly of claim 1 wherein the wear-resistant material is formed of an alloy having spheroidal particles retained by a matrix alloy.

4. The cutting edge assembly of claim 3 wherein the spheroidal particles are of boron, chromium and iron, and the matrix alloy is of iron and boron.

5. The cutting edge assembly of claim 1 wherein the assembly includes a plurality of individual sections.

6. The cutting edge assembly of claim 1 wherein the blocks are cast in the form of a trapezoid.

7. The cutting edge assembly of claim 6 wherein the blocks are equal in size and shape.

8. The cutting edge assembly of claim 1 wherein the blocks are cast in the form of a parallelogram.

9. The cutting edge assembly of claim 8 wherein the blocks are equal in size and shape.

10. The cutting edge assembly of claim 1 wherein the wear-resistant alloy blocks consist of spheroidal particles of about 58% chromium, 9% boron with the remainder iron, surrounded by a matrix alloy of about 3.8% boron with the remainder iron.

* * * * *